US010577757B1

(12) United States Patent
Stern et al.

(10) Patent No.: US 10,577,757 B1
(45) Date of Patent: Mar. 3, 2020

(54) ECCENTRIC WEIGHT SYSTEM WITH REDUCED ROTATIONAL INERTIA FOR VIBRATORY COMPACTOR

(71) Applicant: Caterpillar Paving Products Inc., Brooklyn Park, MN (US)

(72) Inventors: Jeffrey L. Stern, Big Lake, MN (US); Matthew A. Loecken, Nowthen, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/130,893

(22) Filed: Sep. 13, 2018

(51) Int. Cl.
*E01C 19/28* (2006.01)
*B06B 1/16* (2006.01)

(52) U.S. Cl.
CPC ..... *E01C 19/286* (2013.01); *B06B 1/162* (2013.01); *E01C 19/281* (2013.01)

(58) Field of Classification Search
CPC ..... E01C 19/281; E01C 19/286; B06B 1/162
USPC ..... 404/72, 113, 117
See application file for complete search history.

(56) References Cited

U.S. PATENT DOCUMENTS

| | | | | |
|---|---|---|---|---|
| 2,524,359 | A | 10/1950 | Romie | |
| 3,395,626 | A | 8/1968 | Garis et al. | |
| 3,437,019 | A | 4/1969 | Peterson | |
| 3,972,637 | A | 8/1976 | Sutherland | |
| 4,619,552 | A * | 10/1986 | Sadahiro | E01C 19/286 172/40 |
| 5,564,824 | A | 10/1996 | Chaplin et al. | |
| 6,007,273 | A | 12/1999 | Magee | |
| 8,206,061 | B1 * | 6/2012 | Hansen | E01C 19/286 404/128 |
| 8,967,910 | B2 * | 3/2015 | Hansen | B06B 1/00 404/113 |

* cited by examiner

*Primary Examiner* — Raymond W Addie
(74) *Attorney, Agent, or Firm* — Schwegman, Lundberg & Woessner

(57) ABSTRACT

An eccentric weight system includes a first shaft rotatably supported at a first end by a first shaft support and rotatably supported at a second end by a second shaft support. The first and second shaft supports define a first axis of rotation of the shaft. An eccentric weight is supported by the first shaft and has a center of mass that is offset from the first axis of rotation. The eccentric weight is supported so as to be rotatable about a second axis of rotation relative to the first shaft with the second axis of rotation being offset from the first axis of rotation.

20 Claims, 4 Drawing Sheets

ECCENTRIC WEIGHT SYSTEM WITH REDUCED ROTATIONAL INERTIA FOR VIBRATORY COMPACTOR

TECHNICAL FIELD

This disclosure relates generally to vibratory compactor machines and, more particularly, to an eccentric weight system for such a machine.

BACKGROUND

Compactors are widely used in the construction and landscaping industries for the compaction of granular materials. Compactors can have a variety of different configurations including vibratory rammers, vibratory plate compactors and vibratory roller (or drum) compactors. Applications for compactors may include the compaction of sand, gravel, or crushed aggregate for foundations, footings, or driveways; base preparation for concrete slabs, asphalt parking lots, etc. Compactors can also used for the compaction of either hot or cold mix asphalt during patching or repairing of streets, highways, sidewalks, parking lots, etc.

A typical vibratory compactor includes at least one roller that functions to compact a surface. The roller includes a vibratory mechanism that may include an eccentric shaft which can be accelerated by a motor, such as a hydraulic motor, in order to impart vibrations to the roller. Generally, the eccentric shaft has one or more weights press-mounted or welded on the eccentric shaft to achieve a desired eccentric mass. A second motor may be provided to rotate the roller, and thereby move the vibratory compactor forward/backward over the surface to be compacted.

The eccentric shaft may be relatively heavy in weight in order to provide the desired vibrating force on the roller. As a result, the hydraulic motor associated with the eccentric shaft must be capable of producing a relatively high start-up torque to accelerate the eccentric shaft, such as at the beginning of a compacting job. The need to produce this start-up torque can lead to the need for a relatively larger engine for the compactor to power the eccentric shaft motor, which can increase the cost of the compactor as well as increase the amount of emissions produced by the compactor. The large start-up torque can also lead to higher operating costs and wear and tear on the eccentric shaft motor.

SUMMARY

In one aspect, the disclosure describes an eccentric weight system for a vibratory mechanism. The eccentric weight system includes a first shaft rotatably supported at a first end by a first shaft support and rotatably supported at a second end by a second shaft support. The first and second shaft supports define a first axis of rotation of the shaft. An eccentric weight is supported by the first shaft and has a center of mass that is offset from the first axis of rotation. The eccentric weight is supported so as to be rotatable about a second axis of rotation relative to the first shaft with the second axis of rotation being offset from the first axis of rotation In another aspect, the disclosure describes a vibratory compactor. The vibratory compactor includes a compacting mechanism having a first vertical support member and a second vertical support member. A first shaft is rotatably supported at a first end by a first shaft support on the first vertical support member and rotatably supported at a second end by a second shaft support on the second vertical support member. The first and second shaft supports define a first axis of rotation of the shaft. An eccentric weight is supported by the first shaft and has a center of mass that is offset from the first axis of rotation. The eccentric weight is supported so as to be rotatable about a second axis of rotation relative to the first shaft with the second axis of rotation being offset from the first axis of rotation.

In yet another aspect, the disclosure describes a method for producing vibration in a vibratory mechanism. The method includes the steps of supporting rotatably a first end of a first shaft with a first shaft support on a first vertical support member and supporting rotatably a second end of the first shaft with a second shaft support on a second vertical support member. The first and second shaft supports define a first axis of rotation of the shaft. An eccentric weight is supported with the first shaft. The eccentric weight has a center of mass that is offset from the first axis of rotation and the eccentric weight is supported so as to be rotatable about a second axis of rotation relative to the first shaft with the second axis of rotation being offset from the first axis of rotation. The first shaft is rotated about the first axis of rotation.

DETAILED DESCRIPTION

Figure 1:
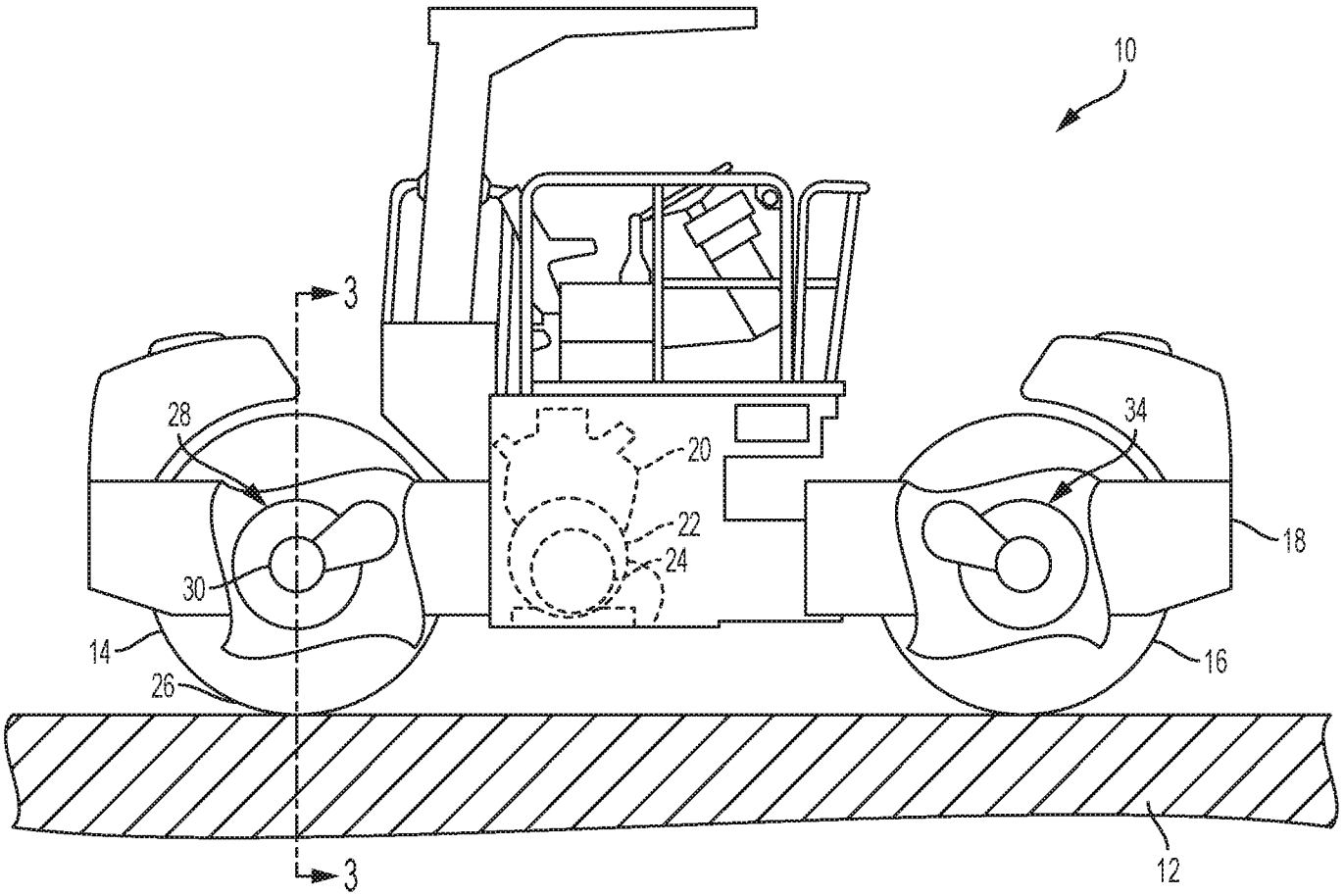
FIG. 1 is a side elevation view of an exemplary vibratory compactor in accordance with the present disclosure.

This disclosure relates generally to a vibratory compactor machine having one or more roller drums that are in rolling contact with a surface to be compacted. With reference to FIG. 1 of the drawings, an exemplary vibratory compactor 10 is shown in accordance with the present disclosure. A compactor is generally used in situations where loose surface material, such as material which can be further packed or densified, is disposed over a surface 12. As the compactor 10 travels over the surface 12, vibrational forces generated by the compactor are imparted to the surface. These vibrational forces acting in cooperation with the weight of the machine, compress the loose material to a state of greater compaction and density. The compactor machine may make one or more passes over the surface to provide a desired level of compaction. In one intended application, the loose material may be freshly deposited asphalt that is to be compacted into roadways or similar hardtop surfaces. However, in other applications, the material may be soil, gravel, sand, land fill trash, concrete or the like.

Referring again to FIG. 1 of the drawings, the compactor 10 is shown with respect to a surface 12 to be compacted. The illustrated compactor 10 is a double roller vibratory compactor having a first compacting roller 14 and a second compacting roller 16 rotatably mounted on a main frame 18. The main frame 18 also supports an engine 20 that, in this case, has first and second hydraulic pumps 22, 24 operatively and conventionally connected thereto. The engine 20 may be a diesel engine, a gasoline engine, a gaseous fuel-powered engine or any other type of engine apparent to one skilled in the art. It is contemplated that the engine 20 may alternately embody a non-combustion source of power such as a fuel cell, a battery or an electric motor if desired. While the compactor 10 shown in FIG. 1 has a particular configuration including two compacting rollers 14, 16, the present disclosure is applicable to any compactor machine that is operable to compact a surface material including, for example, compactors having only a single compacting roller, pneumatic compactors with vibratory mechanisms, plate tampers. The present disclosure is also applicable to other machines with vibratory mechanisms such as hoppers having vibratory mechanisms.

Figure 3:
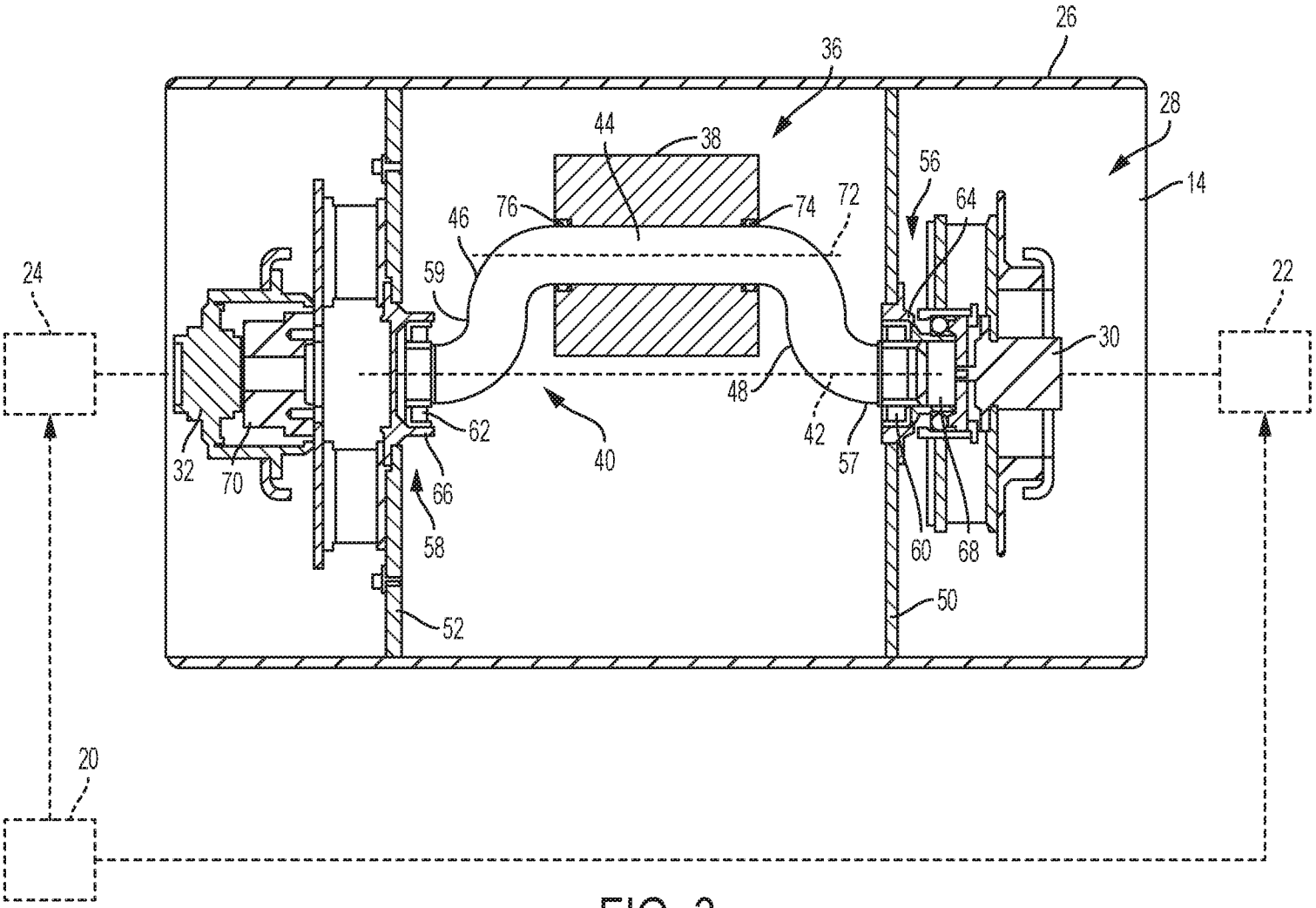
FIG. 3 is a sectional view of a compacting roller of the vibratory compactor of FIG. 1 showing the eccentric weight system of FIG. 2.

Each of the first and second compacting rollers 14, 16 may be configured as an elongated, hollow cylinder with a cylindrical outer wall 26 that encloses an interior volume. The cylindrical roller outer wall 26 may extend along and define a cylindrical roller axis. The second hydraulic pump 24 may be operatively connected to a second hydraulic motor 32, as shown in FIG. 3, that is arranged and configured to impart rotation to the first compacting roller 14 and thereby drive movement of the compactor 10 in a desired direction over the surface 12 being compacted. In some embodiments, the second compacting roller 16 may also be rotatably driven by the second hydraulic motor 32 or by a separate hydraulic motor. A motor other than a hydraulic motor could also be used, such as for example an electric motor. To withstand being in rolling contact with and compacting various surface materials, the roller outer wall 26 can be made from a thick, rigid material such as cast iron or steel. While the illustrated embodiment shows the outer wall 26 of the first and second compacting rollers as having a smooth cylindrical shape, in other embodiments, a plurality of bosses or pads may protrude from the surface of the outer wall 26 to, for example, break up aggregations of the material being compacted.

To impart a vibrational, oscillating or other repeating force through the first compacting roller 14 onto the material being compacted, the first compacting roller 14 includes a vibratory mechanism 28. The vibratory mechanism 28 may be operatively connected to a first hydraulic motor 30 that, in turn, is operatively connected to the first hydraulic pump 22 driven by the engine 20. Motors or devices other than a hydraulic pump and hydraulic motor combination may be used to drive the vibratory mechanism, such as for example an electric motor. Accordingly, the vibratory mechanism of the present disclosure is not limited to only embodiments using hydraulic pumps and motors. In this case, the second compacting roller 16 includes a second vibratory mechanism 34. Since the first compacting roller 14 and the second compacting roller 16 are structurally and operatively similar, the description, construction and elements comprising the first compacting roller 14, as shown in FIG. 3, also applies to the second compacting roller 16. Accordingly, the second compacting roller 16 will not be described in detail herein. While each of the compacting rollers 14, 16 includes a vibratory mechanism 28, 34 in the illustrated embodiment, it will be appreciated that the present disclosure is also applicable to compactors having only a single roller equipped with a vibratory mechanism. Moreover, the present disclosure is also applicable to compactors 10 in which the first compacting roller 14 has a different configuration or operation than the second compacting roller 16.

Figure 2:
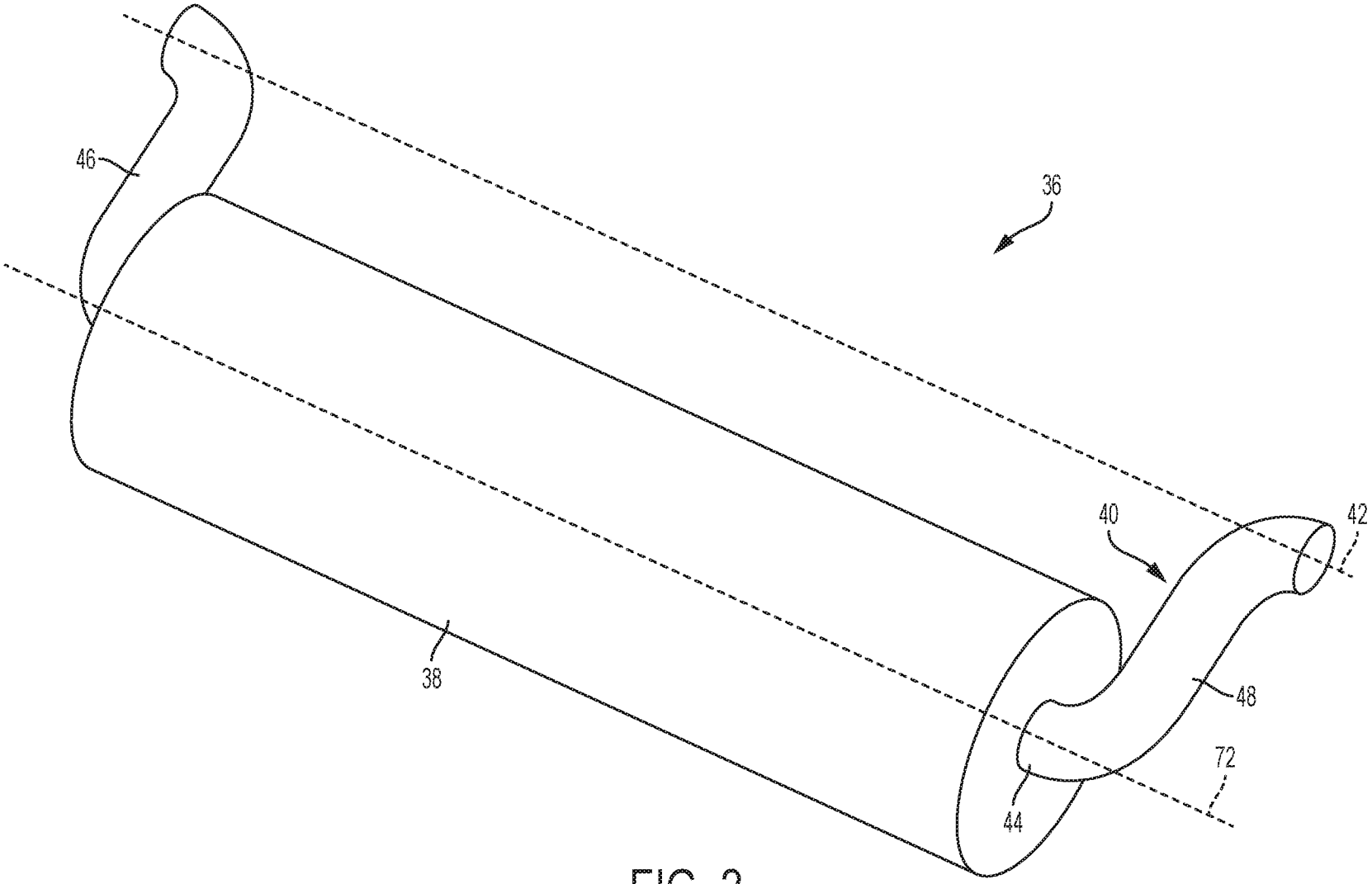
FIG. 2 is an isometric view of one embodiment of an eccentric weight system for the vibratory compactor of FIG. 1.

For facilitating generation of vibrational forces, the vibratory mechanism may include an eccentric weight system 36 such as shown in FIGS. 2-3. The eccentric weight system 36 may include an eccentric weight 38 supported on a rotatable shaft 40. The rotatable shaft 40 may have a first axis of rotation 42 and the eccentric weight 38 may have a center of mass that is offset from the first axis of rotation 42. In the embodiment illustrated in FIGS. 2-3, the rotatable shaft 40 is in the form of a crank shaft that includes an offset center portion 44 having a crank portion 46, 48 at either end thereof. The crank portions 46, 48 are each bent out of the alignment with the first axis of rotation 42 of the rotatable shaft 40. The eccentric weight 38, in this case, is supported on the offset center portion 44 of the rotatable shaft 40. As discussed in greater detail below, the rotatable shaft 40 shown in FIGS. 2-3 is merely one exemplary configuration for a rotating shaft that supports the eccentric weight 38 in a position offset from the first axis of rotation 42 of the shaft and it will be appreciated by those skilled in the art that the rotatable shaft 40 could have configurations other than that shown.

Similarly, the eccentric weight 38 illustrated in FIGS. 2-3 has a substantially cylindrical configuration that is arranged symmetrically with respect to the offset center portion 44 of the rotatable shaft 40 However, as will be appreciated, the eccentric weight 38 could have a configuration other than that shown and/or be supported asymmetrically relative to the center portion 44 of the rotatable shaft 40 in order to provide a desired vibrational effect. For example, the eccentric weight 38 may be divided into a plurality of individual weight elements. The individual weight elements may be movable with respect to each other to produce varying degrees of imbalance during rotation of the eccentric weight system. The amplitude of the vibrations produced by such an arrangement may be varied by positioning the individual eccentric weight elements with respect to each other to vary the average distribution of mass (i.e., the center of mass or centroid) with respect to the first axis of rotation. Vibration amplitude in such a system increases as the center of mass moves away from the first axis of rotation of the eccentric weights and decreases toward zero as the center of mass moves toward the first axis of rotation. Varying the rotational speed of the weight elements about their common axis may change the frequency of the vibrations produced by such an arrangement.

FIG. 3 provides a cross-sectional view of the first compacting roller 14 showing how the eccentric weight system 36 may be supported in the interior of the roller. In particular, the interior of the first compacting roller may include axially spaced, opposing and parallel first and second vertical members 50, 52 that are connected to the interior of the curved outer wall 26 of the first compacting roller 14. The rotatable shaft 40 may extend between the first and second vertical members 50, 52. More specifically, the first and second vertical members 50, 52 may respectively carry first and second shaft supports 56, 58 with the first shaft support 56 being configured to rotatably support a first end 57 of the rotatable shaft 40 and the second shaft support 58 being configured to rotatably support a second end 59 of the rotatable shaft 40. The first and second shaft supports 56, 58 define the first axis of rotation 42 of the rotatable shaft 40. In the illustrated embodiment, the first and second shaft supports 56, 58 are in the form of first and second bearings 60, 62 that are supported respectively in first and second brackets 64, 66 on the first and second vertical members 50, 52.

To drive rotation of the rotatable shaft 40, the first end 57 of the shaft may be connected to a first rotary coupling 68 that, in turn, may be connected to the first hydraulic motor 30 such that rotation of the first hydraulic motor 30 is transferred to the rotatable shaft 40 as shown in FIG. 3. Additionally, the second hydraulic motor 32 may be connected via a second coupling 70 to the first compacting roller 14 such that rotation of the second hydraulic motor 32 may cause rotation of the first compacting roller 14. The rotation of the first compacting roller 14 may propel the vibratory compactor 10 in a forward or backward direction relative to a surface, while compacting the surface 12.

To reduce the total mass inertial effect of the eccentric weight system 36, at least a portion of the eccentric weight 38 may be supported so as to be rotatable about a second axis of rotation 72 relative to the rotatable shaft 40 that is offset from the first axis of rotation 42. For example, in the embodiment illustrated in FIG. 3, the eccentric weight 38 is rotatably supported on the center portion 44 of the rotatable shaft 40 by one or more bearings, in particular axially spaced third and fourth bearings 74, 76. The third and fourth bearings 74, 76 are configured and arranged so as to define the second rotational axis 72 about which the eccentric weight 38 can rotate relative to the rotatable shaft 40. The eccentric weight 38 may represent the bulk of the rotating eccentric mass of the vibratory mechanism. Thus, making the eccentric weight 38 rotatable about the second axis of rotation 72 substantially reduces the rotational portion of the inertia that must be overcome when accelerating the vibratory mechanism 28.

Figure 4:
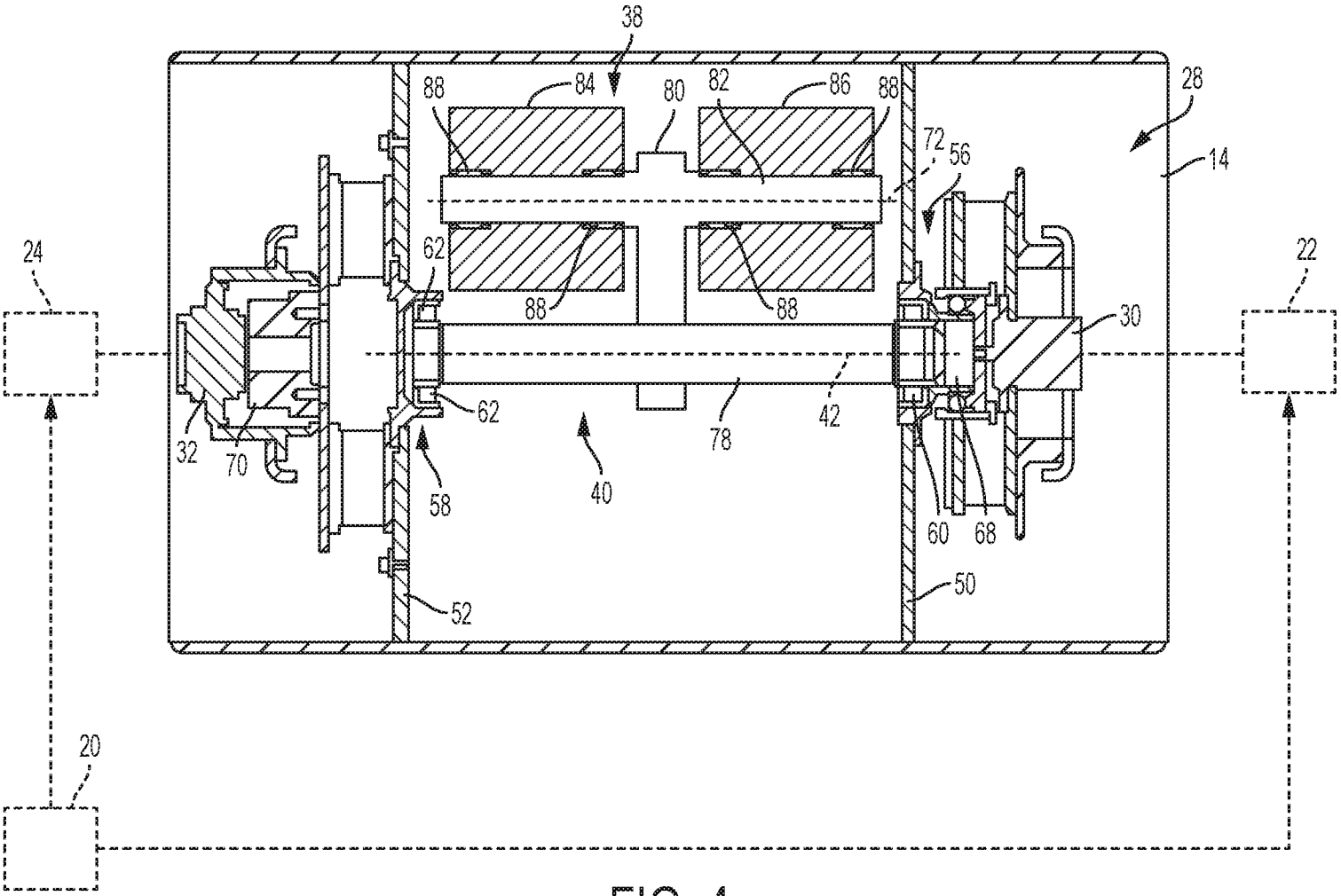
FIG. 4 is a sectional view of a compacting roller of the vibratory compactor of FIG. 2 showing a further embodiment of an eccentric weight system according to the present disclosure.

A further embodiment of the eccentric weight system 36 of the present disclosure is shown in FIG. 4. Elements in FIG. 4 that are substantially the same as elements in the embodiment of FIG. 3 are given the same reference numbers. Instead of a crankshaft arrangement with an offset center portion with crank portions at either end such as shown in FIGS. 2 and 3, the rotatable shaft 40 of the embodiment of FIG. 4 has a main shaft portion 78 that between the first and second bearings 60, 62 and an arm portion 80 that is supported by and extends in substantially perpendicular relation relative to the main shaft portion 78. Like the embodiment of FIG. 3, the first axis of rotation 42 is defined by the first and second bearings 60, 62 and, in this case, is coaxial with the longitudinal axis of the main shaft portion 78. An outer shaft portion 82 that carries the eccentric weight 38 is connected in substantially perpendicular relation to the arm portion 80 in offset relation to the main shaft portion 78 and the first axis of rotation 42. In the illustrated embodiment, the outer shaft portion 82 extends parallel to the main shaft portion 78. Moreover, the illustrated outer shaft portion 82 is divided into two sections each of which extends axially (relative to the drum) outward from the arm portion 80. Each of the two sections carries a respective element of the eccentric weight 38, which in this case is divided into two eccentric weight elements 84, 86. In the embodiment of FIG. 4, each of the elements 84, 86 of the eccentric weight 38 is supported on the respective outer shaft portion 82 by two bearings 88. These bearings 88 define the second axis of rotation 72 about which the eccentric weight elements 84, 86 can rotate relative to the rotatable shaft 40 similarly to the embodiment of FIG. 3.

As will be appreciated from FIGS. 2-4, differently configured rotatable shaft 40 arrangements may be used to support the eccentric weight 38 in offset relation to the first axis of rotation 42 of the shaft. Accordingly, the present disclosure is not limited to any particular arrangement or configuration for the rotatable shaft so long as the rotatable shaft is capable of supporting, directly or indirectly, the eccentric weight with its center of mass in offset relation to the axis of rotation of the shaft.

In operation, the first hydraulic pump 22 supplies pressurized fluid to the first hydraulic motor 30. The first hydraulic motor 30 is configured to rotate the rotatable shaft 40 through the first rotatable coupling 68 at the first end 57 of the shaft. Rotation of the rotatable shaft 40 is initiated as torque is applied at first end by the first hydraulic motor 30. As the rotatable shaft 40 is rotated a centrifugal force is generated due to the eccentric weight system 36. At a certain rotational velocity, the eccentric weight system 36 attains an operating frequency and starts to vibrate due to the net centrifugal force. This vibration induces a vibratory force on the first compacting roller 14 through the first and second vertical members 50, 52.

INDUSTRIAL APPLICABILITY

The vibratory mechanism and, in particular, the eccentric weight system of the present disclosure is applicable to any type of machine having a vibratory mechanism and is not limited to a two-roller vibratory compactor such as shown in FIG. 1 or a vibratory mechanism driven by a hydraulic motor and/or pump such as shown in FIG. 3. Instead, the present disclosure is applicable to any machine that is operable to produce a vibration. In the case of the illustrated embodiment, the operator may actuate the vibration of the first compacting roller 14 by using a user interface, which may be located for example in a cab of the compactor 10. As the operator actuates the vibration command on the user interface, a controller sends command signals to the first hydraulic pump 22, which in turn supplies pressurized hydraulic fluid to the first hydraulic motor 30. The first hydraulic motor 30 rotates the rotatable shaft 40 of the eccentric weight system 36 and accelerates it to an operating frequency. As the eccentric weight system 36 reaches the operating frequency, it starts vibrating due to the offset arrangement of the eccentric weight 38 and such vibrations are imparted to the first compacting roller 14 through the first and second vertical members 50, 52 compacting the surface 12 below the vibratory compactor 10.

A typical eccentric weight system needs significantly more torque/power to accelerate the eccentric weight system, for example, at start-up. As a result, vibratory compactors equipped with such eccentric weight systems must be equipped with a larger than necessary engine to meet the peak power demands of the vibratory mechanism. By placing the bulk of the weight of the rotating eccentric mass on bearings that allow the mass to rotate about a second rotational axis, the eccentric weight system of the present disclosure is able to substantially reduce or eliminate the rotational inertia that must be overcome during acceleration of the vibratory mechanism. Thus, the eccentric weight system of the present disclosure need only overcome the translational inertia of the eccentric weights when accelerating the system. Typical eccentric weight systems, in contrast, must overcome both the full rotational and translational inertial resistance to motion at start-up. In some embodiments, the eccentric weight system of the present disclosure may reduce the power requirement to accelerate the eccentric weight system by a significant amount.

This disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. An eccentric weight system for a vibratory mechanism, the eccentric weight system comprising:

a first shaft rotatably supported at a first end by a first shaft support and rotatably supported at a second end by a second shaft support, the first and second shaft supports defining a first axis of rotation of the shaft; and an eccentric weight supported by the first shaft and having a center of mass that is offset from the first axis of rotation, the eccentric weight being supported so as to be rotatable about a second axis of rotation relative to the first shaft with the second axis of rotation being offset from the first axis of rotation.

2. The eccentric weight system of claim 1 wherein the first shaft is configured as a crank shaft.

3. The eccentric weight system of claim 1 wherein the first and second shaft supports comprise shaft support bearings.

4. The eccentric weight system of claim 1 wherein the eccentric weight comprises a plurality of eccentric weight elements.

5. The eccentric weight system of claim 1 wherein the first shaft includes an offset center portion having a first and second crank portions, the crank portions being bent out of alignment with the first axis of rotation and being arranged at respective first and second ends of the offset center portion.

6. The eccentric weight system of claim 5 wherein the eccentric weight is arranged on the offset center portion of the first shaft.

7. The eccentric weight system of claim 6 wherein the eccentric weight is supported on the offset center portion by at least one bearing with the at least one bearing defining the second axis of rotation.

8. The eccentric weight system of claim 1 wherein the first shaft comprises a main shaft portion that extends co-axially with the first axis of rotation between the first and second shaft supports and an arm portion that is supported by and extends in substantially perpendicular relation relative to the main shaft portion.

9. The eccentric weight system of claim 8 wherein the first shaft further includes an outer shaft portion that is connected in substantially perpendicular relation to the arm portion with the eccentric weight being supported on the outer shaft portion by at least one bearing.

10. The eccentric weight system of claim 9 wherein the outer shaft portion comprises first and second portions each of which extends outward from the arm portion and supports a respective portion of the eccentric weight.

11. A vibratory compactor comprising:

a compacting mechanism having a first vertical support member and a second vertical support member;

a first shaft rotatably supported at a first end by a first shaft support on the first vertical support member and rotatably supported at a second end by a second shaft support on the second vertical support member, the first and second shaft supports defining a first axis of rotation of the shaft; and an eccentric weight supported by the first shaft and having a center of mass that is offset from the first axis of rotation, the eccentric weight being supported so as to be rotatable about a second axis of rotation relative to the first shaft with the second axis of rotation being offset from the first axis of rotation.

12. The vibratory compactor of claim 11 wherein the first shaft includes an offset center portion having a first and second crank portions, the crank portions being bent out of alignment with the first axis of rotation and being arranged at respective first and second ends of the offset center portion and wherein the eccentric weight is arranged on the offset center portion of the first shaft.

13. The vibratory compactor of claim 11 wherein the eccentric weight comprises a plurality of eccentric weight elements.

14. The vibratory compactor of claim 11 wherein the first shaft comprises a main shaft portion that extends co-axially with the first axis of rotation between the first and second shaft supports and an arm portion that is supported by and extends in substantially perpendicular relation relative to the main shaft portion.

15. The vibratory compactor of claim 14 wherein the first shaft further includes an outer shaft portion that is connected in substantially perpendicular relation to the arm portion with the eccentric weight being supported on the outer shaft portion by at least one bearing.

16. The vibratory compactor of claim 15 wherein the outer shaft portion comprises first and second portions each of which extends outward from the arm portion and supports a respective portion of the eccentric weight.

17. A method for producing vibration in a vibratory mechanism comprising:

supporting rotatably a first end of a first shaft with a first shaft support on a first vertical support member;

supporting rotatably a second end of the first shaft with a second shaft support on a second vertical support member, the first and second shaft supports defining a first axis of rotation of the shaft;

supporting an eccentric weight with the first shaft, the eccentric weight having a center of mass that is offset from the first axis of rotation and wherein the eccentric weight is supported so as to be rotatable about a second axis of rotation relative to the first shaft with the second axis of rotation being offset from the first axis of rotation; and rotating the first shaft about the first axis of rotation.

18. The method of claim 17 wherein the first shaft includes an offset center portion having a first and second crank portions, the crank portions being bent out of alignment with the first axis of rotation and being arranged at respective first and second ends of the offset center portion and wherein the eccentric weight is arranged on the offset center portion of the first shaft.

19. The method of claim 17 wherein the first shaft comprises a main shaft portion that extends co-axially with the first axis of rotation between the first and second shaft supports and an arm portion that is supported by and extends in substantially perpendicular relation relative to the main shaft portion, the first shaft further including an outer shaft portion that is connected in substantially perpendicular relation to the arm portion with the eccentric weight being supported on the outer shaft portion by at least one bearing.

20. The method of claim 17 wherein the eccentric weight comprises a plurality of eccentric weight elements.

* * * * *